US005271324A

United States Patent [19]

Kiamco et al.

[11] Patent Number: 5,271,324

[45] Date of Patent: * Dec. 21, 1993

[54] LOCKING DEVICE FOR A PRINTING PRESS

[75] Inventors: Robert C. Kiamco, Wood Dale; C. K. Shah, Niles; Louis S. Depa, Downers Grove, all of Ill.

[73] Assignee: Rockwell International Corporation, El Segundo, Calif.

[ * ] Notice: The portion of the term of this patent subsequent to Sep. 21, 2010 has been disclaimed.

[21] Appl. No.: 947,322

[22] Filed: Sep. 18, 1992

[51] Int. Cl.[5] ..... B41F 27/12

[52] U.S. Cl. ..... 101/415.1; 101/378

[58] Field of Search ..... 101/378, 382.1, 383, 101/389.1, 415.1, 477, DIG. 36, 216

[56] References Cited

U.S. PATENT DOCUMENTS

| | | | |
|---|---|---|---|
| 912,724 | 2/1909 | Pancoast | 101/415.1 |
| 1,604,082 | 10/1926 | Smothers | 101/415.1 |
| 2,051,858 | 8/1936 | Huck et al. | 101/415.1 |
| 3,166,012 | 1/1965 | Hantscho | 101/415.1 |
| 4,527,478 | 7/1985 | Difflipp et al. | 101/415.1 |
| 4,546,702 | 10/1985 | Dorow | 101/415.1 |
| 4,829,896 | 5/1989 | Norkus | 101/415.1 |

FOREIGN PATENT DOCUMENTS

| | | | |
|---|---|---|---|
| 4995 | 5/1920 | Netherlands | 101/415.1 |

*Primary Examiner*—Edgar S. Burr
*Assistant Examiner*—Stephen R. Funk
*Attorney, Agent, or Firm*—C. B. Patti; V. L. Sewell; H. F. Hamann

[57] ABSTRACT

A locking device (12) for a printing press (10) having a cylinder (40) with a slot (46). The device (12) has a slide block (54) slidably received in the slot (46) and being movable inwardly and outwardly in the slot (46). A blanket (68) extends peripherally around the cylinder (40) and has opposed ends secured between the slide block (54) and cylinder (40) with the slide block (40) located at an inner position in the slot (46).

11 Claims, 4 Drawing Sheets

LOCKING DEVICE FOR A PRINTING PRESS

BACKGROUND OF THE INVENTION

The present invention relates to locking devices for printing presses.

In the past, blankets, such as for offset lithography, have been used on blanket cylinders for printing a document, such as a newspaper. Typically, the blanket cylinder has been provided with a slot to receive leading and trailing edges of the blanket. It has been found that some difficulty may be encountered in securing the edges of the blanket in the slots. Prior devices which have been used for this purpose have been unduly complex and complicated in their use, and may require the use of special tools for securement or locking in an environment where the tools may be accidentally dropped into the press, thus causing damage to the press. In addition, in the past, the blankets have formed a gap, such as 0.25" to 0.375" in the region of the blanket ends which are secured to the cylinder. Such relatively wide gaps may inhibit high press speeds, or may cause a print streak or slur, and also may cause noisiness of the press during operation. In addition, the prior devices may limit the effective width of the press.

SUMMARY OF THE INVENTION

A principal feature of the present invention is the provision of an improved locking device for a printing press.

The locking device of the present invention comprises, a cylinder having an outer surface and an elongated slot adjacent the outer surface, with the slot having a lower surface and a pair of opposed first and second side surfaces extending between the lower surface of the slot and the outer surface of the cylinder. The locking device has a slide block having an outer surface and being slidably received in the slot, with the slide block being movable between a first inner position with the outer surface of the slide block being flush with the outer surface of the cylinder, and a second outer position with the slide block being raised above the outer surface of the cylinder. The device also has a blanket having one end received against the first surface of the slot and a second end received against a first side surface of the slide block facing the first surface of the slot while the slide block is located in the second outer position with the blanket extending peripherally around the outer surface of the cylinder.

A feature of the present invention is the provision of means for releasably locking the slide block at the first inner position with the opposed ends of the blanket being locked together between the surfaces of the slot and the slide block.

Thus, a feature of the present invention is that the blanket may be locked to the cylinder in a simplified manner.

Yet another feature of the invention is that the blanket may be secured to the blanket cylinder automatically when the slide block is moved to its inner position.

Yet another feature of the invention is that the blanket may be positioned in the locking device in a simplified manner.

A further feature of the invention is that the blanket which is secured by the locking device presents a relatively small non-print gap of approximately 0.090".

Yet another feature of the invention is that the gap presented by the device and blanket is greatly reduced in order to increase the press speed without producing print streaks or slurs.

A further feature of the invention is that the device and blanket permit a wider web width press.

Still another feature of the invention is that the press operates in a more quiet manner with a minimized disturbance of the reduced gap in the press.

Yet another feature of the invention is that the locking device is of simplified construction and reduced cost.

Further features will become more fully apparent in the following description of the embodiments of this invention, and from the appended claims.

DESCRIPTION OF THE PREFERRED EMBODIMENTS

Figure 1:
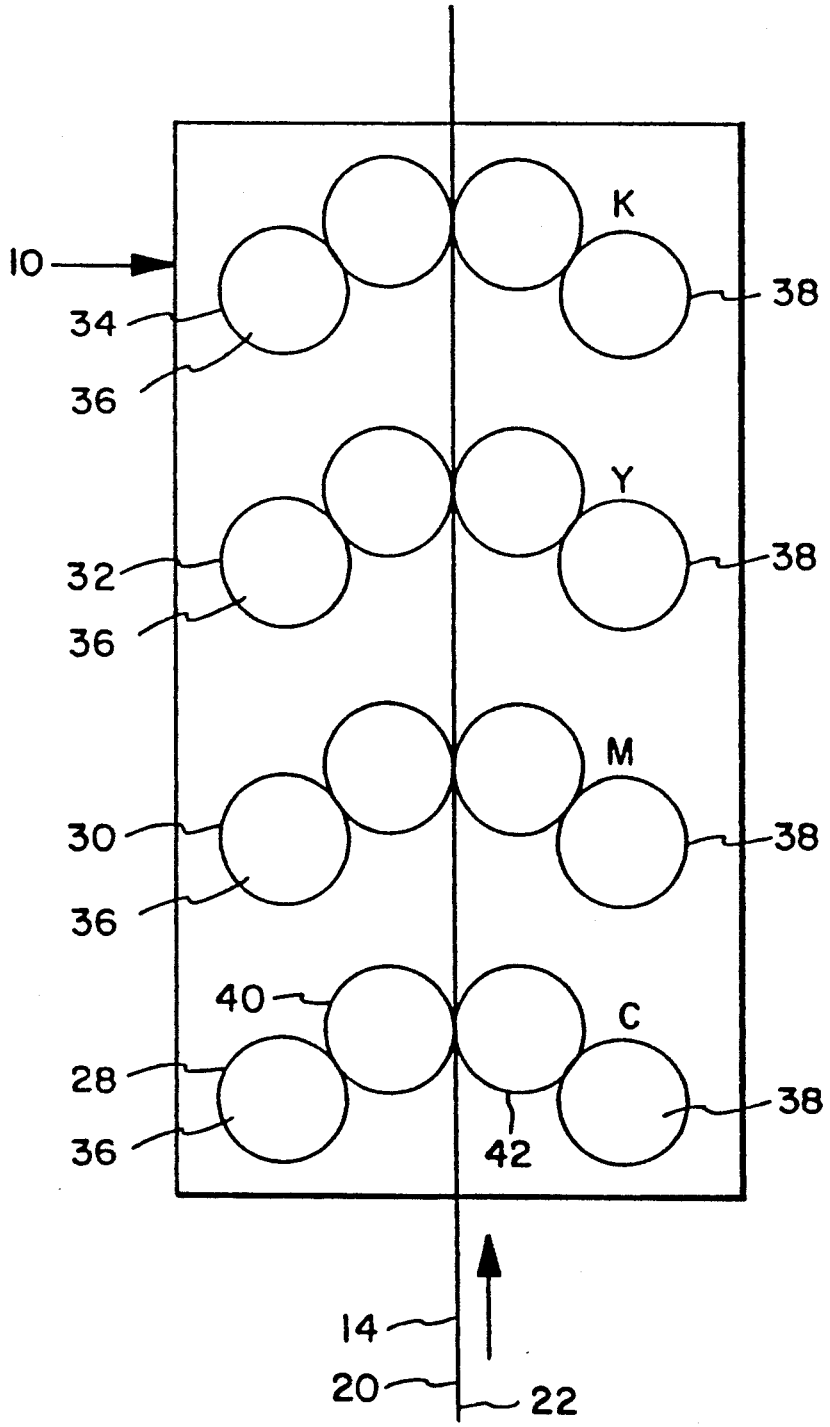
FIG. 1 is a diagrammatic view of a printing press.

Referring now to FIG. 1, there is shown a printing press generally designated 10 for printing an image on a paper web 14. The press 10 has a plurality of printing units 28, 30, 32, and 34 for printing different colors of ink on the web 10. As shown, the printing unit 28 may print an ink having a color Cyan C, the printing unit 30 may print an ink having a color Magenta M, the printing unit 32 may print an ink having the color Yellow Y, and the printing unit 34 may print an ink having a color Black K in a four-color printing press 10.

The printing units 28, 30, 32, and 34 each have a plurality of plate rolls or cylinders 36 associated with a blanket cylinder or roll 40. During printing by the press 10, an image of the ink is transferred from the plate rolls 36 to the associated blanket roll 40 to print the image on one surface 20 of the web 14. In addition, the press 10 may have a plurality of printing units having a plurality of plate rolls 38 associated with a plurality of blanket rolls or cylinders 42 on an opposed side 22 of the web 14 in order to transfer the ink image from the plate rolls 38 to the blanket rolls 42 for printing an image on the other surface 22 of the web 10.

Figure 2:
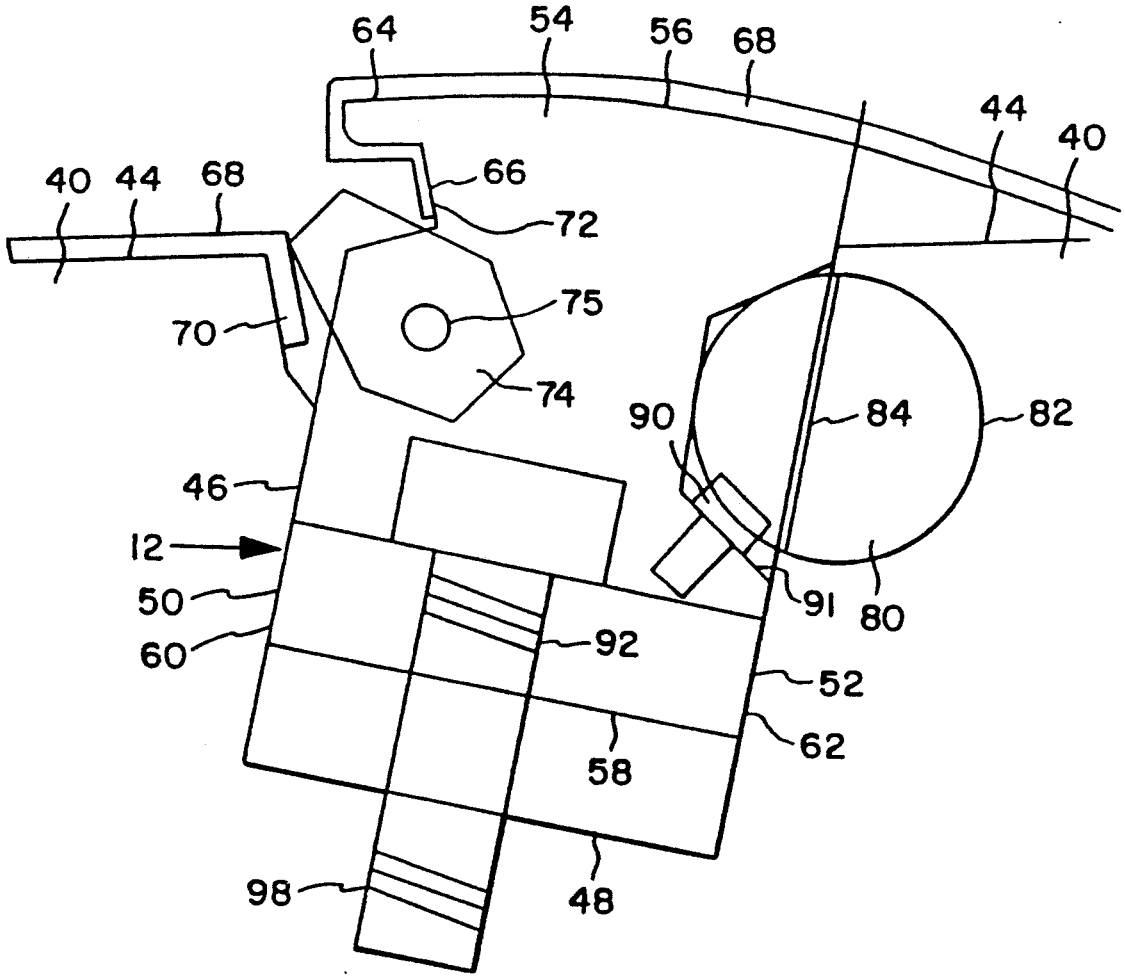
FIG. 2 is a fragmentary sectional view illustrating a locking device for the press located in an outer position.
Figure 3:
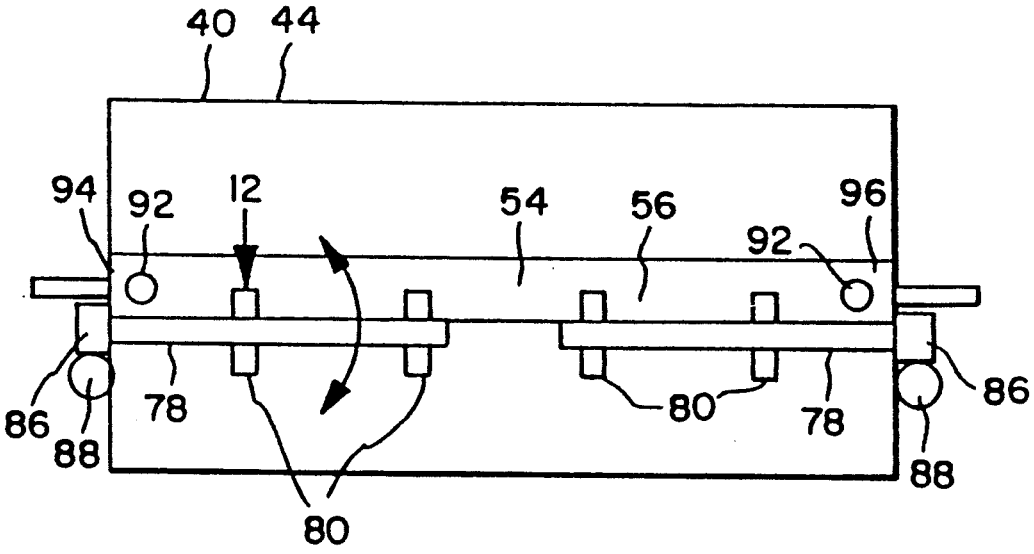
FIG. 3 is a diagrammatic view of the locking device of FIG. 2 on a cylinder of the press.

Referring to FIGS. 2 and 3, there is shown a locking device generally designated 12 for the blanket cylinders 40 and 42 of the press 10. Although the locking device 12 will be discussed in connection with the blanket cylinder 40, for convenience, it will be understood that the locking device 12 may also be used in conjunction with the opposed blanket cylinder 42 in a similar manner.

The blanket cylinder 40 has an outer surface 44, and an elongated slot 46 located adjacent the outer surface 44 of the blanket cylinder 40, such that the slot 46 extends from the outer surface 44 of the blanket cylinder 40. The slot 46 has a lower surface 48 and a pair of opposed first and second side surfaces 50 and 52 extending from the lower surface 48 of the slot 46 to the outer surface 44 of the blanket cylinder 40.

Figure 4:
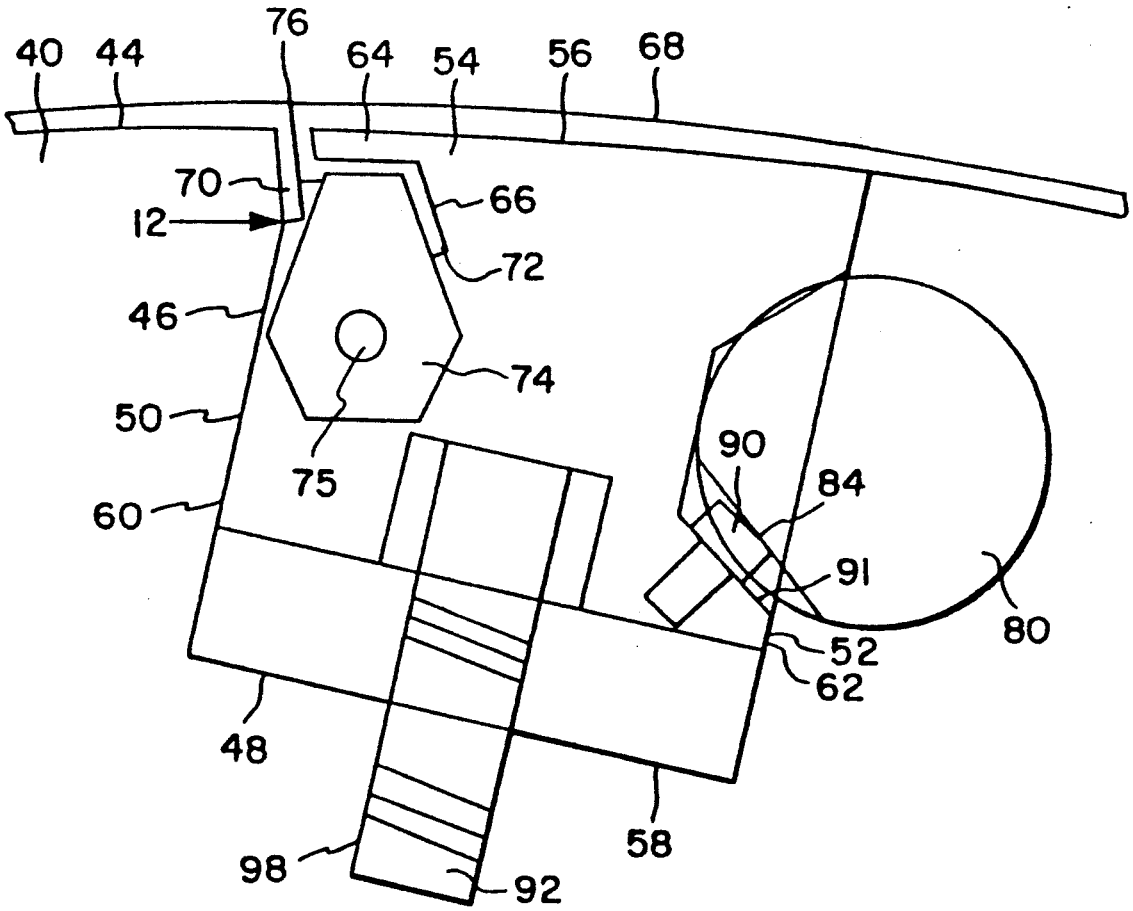
FIG. 4 is a fragmentary sectional view showing the slide block moved to an inner locking position.

The locking device 12 has an elongated slide block 54 being slidably received in the slot 46, such that the slide block 54 is movable between a first inner position with an outer surface 56 of the slide block 54 being flush with the outer surface 44 of the cylinder 40, as shown in FIG. 4, and a second outer position with the slide block 54 projecting above the outer surface 44 of the blanket cylinder 40, as shown in FIG. 2.

The slide block 54 has a lower surface 58 facing the lower surface 48 of the slot 46, a first side surface 60 facing the first surface 50 of the slot 46, and a second opposed side surface 62 facing the second surface 52 of the slot 46. The slide block 54 has an outer tongue 64 being directed toward the first surface 50 of the slot 46, and forming a recess 66 beneath the tongue 64.

The cylinder 40 has an associated blanket 68 having one end 70 of the blanket 68 being received against the first surface 50 of the slot 46 and a second opposed end 72 received against the first side surface 60 of the slide block 54 beneath the tongue 64, and facing the first surface 50 of slot 46. The blanket 68 extends peripherally around the outer surface 44 of the cylinder 40.

As shown in FIG. 2, the second end 72 of the blanket 68 extends over the tongue 64 into the recess 66 of the slide block 54 where it is locked in place. The locking device 12 has a locking lever 74 pivotally mounted by a pin 75 to the slide block 54. As shown in FIG. 2, the locking lever 74 is spaced from the tongue 64 and the recess 66 in order to permit placement of the second end 72 of the blanket 68 into its securement position, with the second end 72 of the blanket 68 being received in the recess 66.

However, when the slide block 54 is moved to its inner position, as shown in FIG. 4, the locking lever 74 engages against the cylinder 40 in the region adjacent the first surface 50 of the slot 46, and the locking lever 74 rotates against the second end 72 of the blanket 68, where the locking lever 74 is received in the recess 66 of the slide block 44, and engages against the second end 72 of the blanket 68 in order to releasably retain the second end 72 of the blanket 68 in place. As shown in FIG. 4, the first end 70 of the secured blanket 68 is closely spaced from the second end 72 of the blanket 68, and is secured in place against the first surface 50 of the slot 46, thus rendering a very small non-print gap 76 between the first and second ends 70 and 72 of the blanket 68. Thus, in this manner, the blanket 68 is automatically locked in place when the slide block 54 is moved from the outer position to the inner position.

With reference to FIGS. 2 and 3, the device 12 has a pair of elongated aligned shafts 78, which are positioned adjacent opposed ends of the cylinder 40. The locking device 12 has a plurality of cam members 80 secured to the shafts 78. The shafts 78 are rotatably secured in the cylinder 40, such that the cam members 80 may be rotated on the shafts 78. As shown in FIG. 3, the locking device 12 may have a pair of cam members 80 associated with each of the shafts 78. With reference to FIG. 2, the cylinder 40 has an oval shaped cut-out 82 to receive each of the cam members 80, with the cam members 80 rotating in the cut-outs or cavities 82. The cam members 80 have a locking surface 84 generally aligned with the second surface 52 of the slot 46 in a non-locking position of the cam members 80, with the locking surfaces 84 facing the slide block 54. With reference to FIG. 3, the shafts 78 have a gear 86 secured to the shafts 78 adjacent an outer end of the shafts 78, with the gears 86 meshing with a worm gear 88 which may be turned by a suitable wrench.

When the worm gears 88 are turned by the wrench, the gears 86 are rotated along with the shaft 78 in order to rotate the cam members 80 selectively by the wrench, and thus move the cam members 80 to a second rotatable locking position, as shown in FIG. 4, with the locking surface 84 of the cam members 80 engaging against a button 90 or ledge 91 on the slide block 54 in order to releasably retain the slide block 54 at its inner locking position. Thus, when the slide block 54 is moved to its inner position with the blanket 68 in place, the cam members 80 are rotated in order to releasably lock the slide block 54 at its inner position. When it is desired to remove the blanket 68 from the cylinder 40, the cam members 80 are rotated by the wrench to its first position, as shown in FIG. 2, in order to permit movement of the slide block 54 to its outer position and remove the blanket 40 from the slide block 54 and cylinder 40.

In addition, as shown in FIGS. 2–4, the locking device 12 has a pair of threaded bolts 92 located adjacent the opposed ends 94 and 96 of the slide block 54. The bolts 92 are releasably received in a pair of associated threaded bores 98 beneath the bolts 92. Thus, when the slide block 54 is moved to its inner position, the bolts 92 may be turned and threaded into the associated bores 98 in order to also releasably lock the slide block 54 at its inner position. Of course, the threaded bolts 92 are removed from the threaded bores 98 when it is desired to move the slide block from its inner position, as shown in FIG. 4, to its outer position, as shown in FIG. 2.

Thus, in accordance with the present invention, a locking device 12 may be used to secure the blankets 68 on blanket cylinders 40 in a simplified manner at an inner position of a slide block 54. The slide block 54, in conjunction with a locking lever 74, automatically locks the ends 70 and 72 of the blanket 68 in place between the slide block 54 and a slot 46 of the cylinder 40 when the slide block 54 is moved to its inner position. In addition, cam members 80 may be moved to a second locking position in order to releasably lock the slide block 54 at its inner position. Further, bolts 92 may also be used to releasably lock the slide block 54 at its inner position. In this manner, the slide block 54 is releasably locked at its inner position in a simplified manner while reducing the non-print gap 76 between the ends 70 and 72 of the blanket 68 in order to provide an increased printing speed of the press 10 or a wider width press. The press speed is increased without producing printing streaks or slurs, and the press 10 operates in a more quiet manner due to less gap disturbance.

The foregoing detailed description has been given for clearness of understanding only, and no unnecessary limitations should be understood therefrom, as modifications will be obvious to those skilled in the art.

What is claimed is:

1. A locking device for a printing press, comprising:

a cylinder having an outer surface and an elongated slot adjacent the outer surface, with the slot having a lower surface and a pair of opposed first and second side surfaces extending between the lower surface of the slot and the outer surface of the cylinder;

a slide block having a pair of opposed sides, and an outer surface and being slidably received in said slot, means mounting said slide block for linear movement between a first inner position with the outer surface of the slide block being flush with the outer surface of the cylinder, and a second outer position with both sides of the slide block projecting above the outer surface of the cylinder;

a blanket having one end received against the first surface of the slot and a second end received against a first side surface of the slide block facing the first surface of the slot while the slide block is located in the second outer position, with the blanket extending peripherally around the outer surface of the cylinder; and means for releasably locking the slide block at the first inner position with the opposed ends of the blanket both being locked between the first surface of the slot and the slide block.

2. The device of claim 1 wherein the locking means comprises a threaded bolt received in a threaded bore adjacent the lower surface of the slot and with the bolt extending through at least a portion of the slide block.

3. The device of claim 2 wherein the bolt is located adjacent an end of the slide block.

4. The device of claim 1 wherein the locking means comprises a rotatable cam located adjacent a second side surface of the slide block and in the second side surface of the slot.

5. The device of claim 4 wherein the slide block has an inner ledge facing the second surface of the slot, and in which the cam has a locking surface which is movable against the ledge of the slide block to lock the slide block at the inner position.

6. The device of claim 5 wherein the locking surface of the cam is movable to a second position drawn away from the ledge to permit movement of the slide block to the second outer position.

7. The device of claim 1 wherein the locking means comprises a locking lever being movable between a first position spaced away from the first surface of the slide block, and a second locking position engaged against the second end of the blanket between the locking lever and the first surface of the slide block.

8. The device of claim 7 wherein the slide block includes a lateral recess to receive the second end of the blanket, with the locking lever engaging the second end of the blanket in the recess at the inner position of the slide block.

9. The device of claim 7 wherein the locking lever is rotatably mounted in the slide block.

10. The device of claim 7 including means for moving the locking lever inwardly in the cylinder as the slide block is moved to the inner position such that the locking lever is moved to the locking position responsive to movement of the slide block to the inner position.

11. The device of claim 1 wherein the cylinder comprises a blanket cylinder.

* * * * *